United States Patent [19]

Yamada

[11] Patent Number: 5,015,196

[45] Date of Patent: May 14, 1991

[54] LOW INSERTION FORCE CONNECTOR AND ELECTRICAL CONTACT THEREFOR

[75] Inventor: Masahiro Yamada, Yokohama, Japan

[73] Assignee: E. I. Du Pont de Nemours and Company, Wilmington, Del.

[21] Appl. No.: 467,521

[22] Filed: Jan. 19, 1990

[30] Foreign Application Priority Data

Jan. 18, 1989 [JP] Japan ..... 1-4128[U]

[51] Int. Cl.[5] ..... H01R 13/62

[52] U.S. Cl. ..... 439/326

[58] Field of Search ..... 439/326, 327, 328, 630, 439/636, 62, 637

[56] References Cited

U.S. PATENT DOCUMENTS

| | | | |
|---|---|---|---|
| Re. 26,692 | 10/1969 | Ruehlemann | 439/637 |
| 4,264,114 | 4/1981 | Chandler | 439/62 |
| 4,575,172 | 3/1986 | Walse et al. . | |
| 4,691,975 | 9/1987 | Fukunaga et al. | 439/266 |
| 4,695,111 | 9/1987 | Grabbe et al. | 439/328 |
| 4,737,120 | 4/1988 | Grabbe et al. | 439/326 |
| 4,781,612 | 11/1988 | Thrush . | |
| 4,911,653 | 3/1990 | Walton et al. | 439/326 |

FOREIGN PATENT DOCUMENTS

| | | | |
|---|---|---|---|
| 52973 | 7/1982 | European Pat. Off. | 439/326 |
| 257746 | 7/1987 | European Pat. Off. . | |

*Primary Examiner*—Joseph H. McGlynn
*Assistant Examiner*—Hien P. Vu

[57] ABSTRACT

A low insertion force type connector is provided which comprises an elongated housing made of an insulating material and having an elongated cavity in a longitudinal direction. A plurality of contacts are located at predetermined intervals along the length of the elongated cavity and are adapted to contact an edge portion of the printed circuit board. A pair of latches are located at opposite ends of the housing providing a spacing defined therebetween over the cavity. Each contact comprises first contact means having a first contact portion for contacting one surface of the printed circuit board and second contact means having a second contact portion for contacting the other surface of the printed circuit board, and a pin portion for supporting the first and second contact means. The second contact means has a spring portion located between the second contact portion and the pin portion, the spring portion comprising a base portion connected to the pin portion, a vertical portion vertically extending from the base portion, and a U-shaped portion extending from the top of the vertical portion and having a free end connected to the second contact portion.

7 Claims, 4 Drawing Sheets

LOW INSERTION FORCE CONNECTOR AND ELECTRICAL CONTACT THEREFOR

BACKGROUND OF THE INVENTION

1. Field of the Invention

The present invention relates to electrical connectors and particularly to a low insertion force type connector and electrical contact therefor which are to be electrically connected to a printed circuit board.

2. Description of the Related Art

Examples of prior art low insertion force type electrical connectors for printed circuit boards are disclosed in U.S. Pat. No. 4,575,172 issued Mar. 11, 1986 and U.S. Pat. No. 4,737,120 issued Apr. 12, 1988. A sectional view of the connector of U.S. Pat. No. 4,575,172 is schematically illustrated in FIG. 1 while a similar view of the connector of the U.S. Pat. No. 4,737,120 is shown in FIG. 2. Both are of the type wherein a printed circuit board 15 is inserted into the connector and vertically held in proper place.

The prior art connector shown in FIG. 1 has a pair of curved spring members 16 with their contact portions offset relative to each other. Since the spring members are formed from the same short bar, they do not provide adequate flexibility when a printed circuit board is inserted into the connector. In order to improve the flexibility of these spring members sufficiently, it would be necessary to make them much thinner. Too thin a spring member, however, may not have the necessary mechanical strength.

The prior art connector shown in FIG. 2 employs a lengthy, meandering spring 16 in comparison with the short spring members shown in FIG. 1. Since, however, the distance between the pivot points and the contact portion of the springs is restricted by the hight of a housing 11, spring 16 also does not provide adequate spring deflection.

In both of the above prior art connectors, the spring action is relatively large because of the proximity of the pivot positions to the contact portions. Spring action increases as the closer the contact portion is a pivot point. More force is then required to insert the printed circuit board into the connector. This results in increased wear of the surfaces of the printed circuit board with each insertion of the board into the connector. These connectors do not therefore provide a sufficiently stable contact force.

SUMMARY OF THE INVENTION

It is accordingly the object of the present invention to provide a low insertion force type connector which has a contact whose spring portion allows for greater deflection and therefor a more stable contact force.

According to the present invention, there is provided a low insertion force connector comprising:

an elongated housing made of an insulting material and having an elongated cavity in a longitudinal direction;

a plurality of contacts disposed at predetermined intervals along the length of the elongated cavity and adapted to contact a edge of a printed circuit board;

each said contact comprising first contact means having a first contact portion for contacting one surface of the edge of the printed circuit board, second contact means having a second contact portion for contacting an opposite surface of the edge of the printed circuit board, and a pin portion for supporting the first and second contact means;

said second contact means further including a spring portion located between the second contact portion and the pin portion, said spring portion comprising a base portion connected to the pin portion, a vertical portion extending vertically from the base portion and a U-shaped portion extending from the top of the vertical portion and having a free end terminating in said second contact portion; and a pair of latches located on opposite ends of the elongated housing providing a spacing defined therebetween above the cavity.

In the connector of the present invention, the second contact portion is supported by the pin portion via the spring portion. The spring portion comprises the vertical portion and the U-shaped portion, offering the spring portion a much greater length compared with that of the prior art connectors.

In use, the edge of the printed circuit board is inserted into each respective contact positioned in the housing with one surface at the edge of the board guide or supported by the first contact portion of the contact. The circuit board is then rotated toward the second contact portion of the contact. As a result, the second contact portion is pushed by the opposite surface at the edge of the printed circuit board against the elastic spring action of the U-shaped portion toward the proximal end of the U-shaped portion of the spring portion. A firm contact force between the printed circuit board and the contact is thereby obtained. At this time, the second contact portion has adequate flexibility due to the presence of the U-shaped portion. Furthermore, the proximal end of the U-shaped portion of the spring portion serves as a stopper upon the elastic deformation of the second contact portion toward the proximal end of the U-shaped portion. The printed circuit board, upon being displaced to a final contact position, is held by the latches over the cavity of the housing.

The present invention also provides an electrical contract for a low insertion force connector comprising:

first contact means having a first contact portion for contacting one surface of a substrate, second contact means having a second contact portion for contacting a second surface of the substrate, a pin portion extending downward form the location where said first and second contact means meet; and a spring portion forming part of said second contact means and located between the second contact portion and the location where said first and second contact means meet, said spring portion including a base portion connected to the pin portion, a vertical portion extending vertically from said base portion, and a U-shaped portion extending from the top of the vertical portion and terminating at its other end in said second contact portion.

The present invention thus provides a low insertion force type connector which has adequate deflection of the specifically designed contact within the connector in spite of its small dimension. The present invention also provides that the printed circuit board is inserted with a light force into the connector due to the elastic spring action of the U-shaped spring portion.

DETAILED DESCRIPTION OF THE PREFERRED EMBODIMENTS

Embodiments of the present invention are described below with reference to the accompanying drawings.

Figure 1:
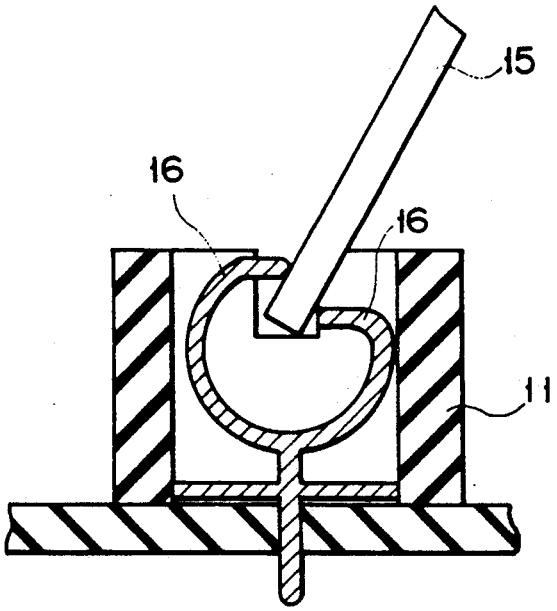
PRIOR ART FIG. 1
FIG. 1 schematically illustrates a cross-sectional view of a prior art connector.
Figure 2:
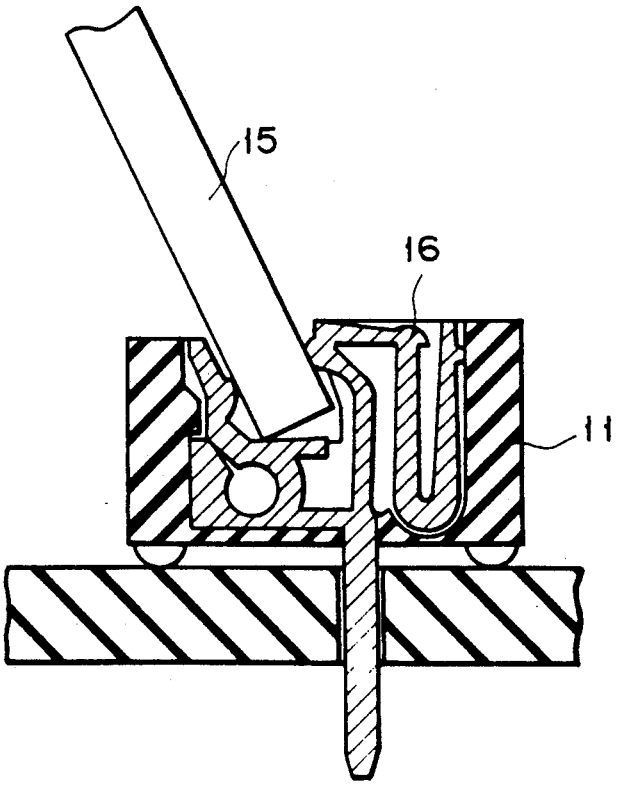
PRIOR ART FIG. 2
FIG. 2 schematically illustrates a cross-sectional view of another prior art connector.
Figure 3:
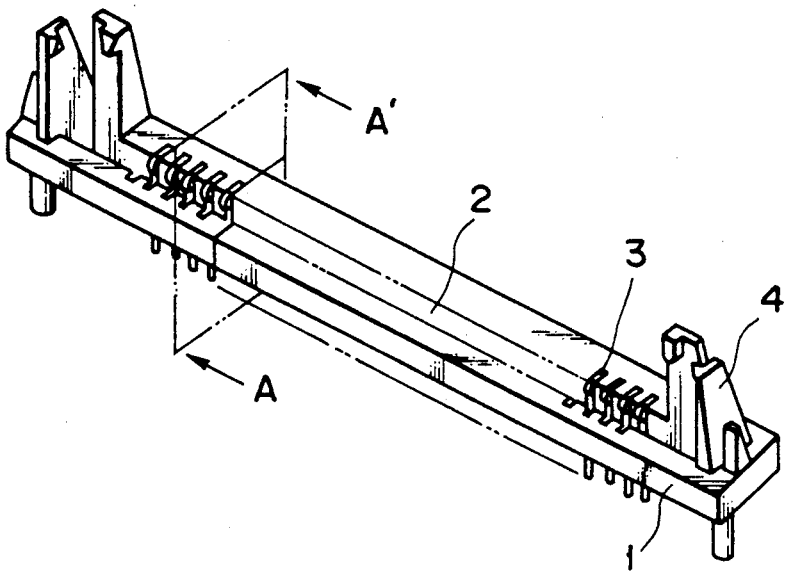
FIG. 3 is a respective view showing a low insertion force connector according to an embodiment of the present invention.

The low insertion force connector shown in FIG. 3 comprises an elongated housing 1 made of an insulating material. The housing 1 has a cavity 2 extending in the connector's longitudinal direction. Grooves 3 are formed at predetermined intervals along the length of the cavity 2 to hold contacts. Each contact is adapted to contact electrically and mechanically an insertion edge of a circuit board substrate such as a printed circuit board. A pair of elastic latches 4 are formed integral with the housing such that they are located opposite to each other with a spacing defined therebetween over the cavity.

Figure 4:
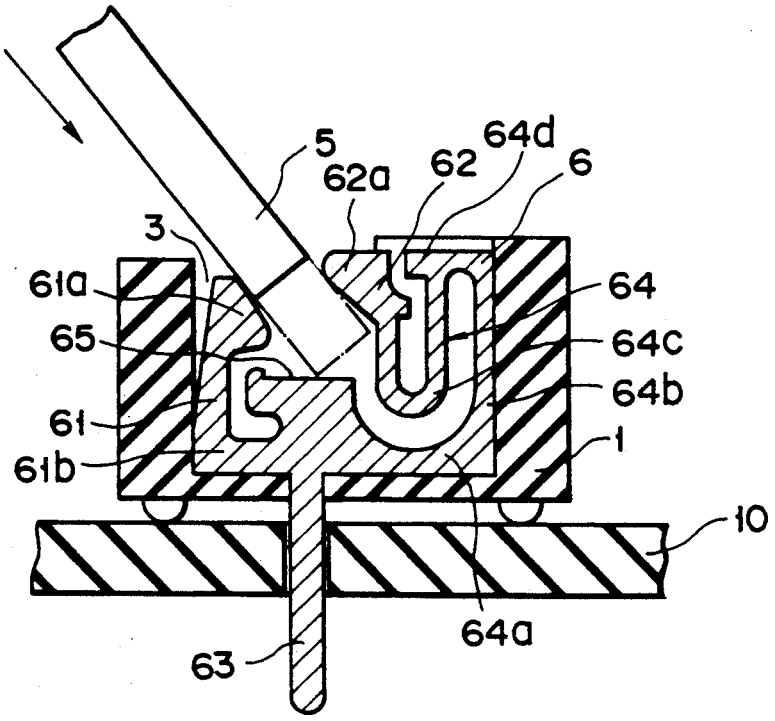
FIGS. 4 and 5 each show a cross-sectional view, taken along line A—A in FIG. 3, before and after rotation of a printed circuit board inserted into the connector to a final vertical position.

FIG. 4 is a sectional view showing a state in which a printed circuit board 5 is being inserted into one of the contacts 6 which is located in the groove 3. Each contact 6 has a first contact means 61 which includes a first contact portion 61*a* for contacting a surface on one side of the insertion edge of the printed circuit board 5. Each contact 6 also has a second contact means 62 which includes a second contact portion 62*a* for contacting a surface on the other side of the insertion edge portion of the printed circuit board. A pin portion 63 is located where the first and second contact means meet. The pin portion supports the first and second contact means and extends downward in the form of a pin contact or terminal for connection to another substrate 10 or to some other type of connector. The second contact means 62 further includes a spring portion 64 located between the second contact portion 62*a* and the pin portion 63. The spring portion 64 comprises a base portion 64*a* connected to the pin portion 63, a vertical portion 64*b* vertically extending from the base portion, an inner U-shaped portion 64*c* extending from the top of the vertical portion. The free end of the U-shaped portion terminates in the second contact portion 62*a*.

A horizontal portion 61*b* of first contact means 61 joins the base portion 64*a* of spring portion 64 where it also meets the pin portion 63. In the vicinity where horizontal portions 61*a* and 64*a* meet there is a raised portion 65 opposite the pin portion 63. The raised portions provides a surface against which the edge of the printed circuit board 5 may ride during insertion and rotation.

Figure 5:
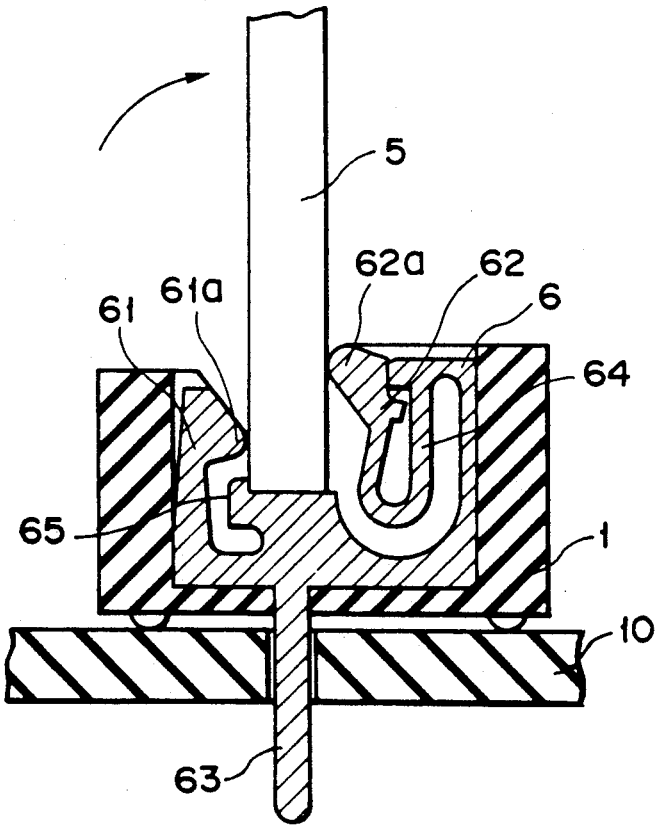

The printed circuit board 5 is inserted into the contact 6 with the inner surface of the first contact portion 61*a* serving as a guide surface, and is rotated toward the second contact portion 62*a* until the board reaches final contact position. FIG. 5 shows a vertical final contact position of the inserted printed circuit board 5. The term "final contact position" means the final position of the printed circuit 5 after rotation and riding on raised surface 65 to the point where it may be held by the elastic latches 4. The rotation of the printed circuit board 5 urges the second contact portion 62*a* so as to generate contact force by elastically deflecting the second contact portion 62*a* through the spring action of the U-shaped portion 64*c* of spring portion 64 until the back of the second contact portion 62*a* abuts with the proximal other end 64*d* of the U-shaped portion. The proximal end 64*d* of the U-shaped portion 64*c* acts as a stopper, thus preventing excess stress from being inflicted on the contact itself. It is, therefore, unnecessary to provide any other stopper. The printed circuit board 5, upon being rotated relative to the second contact means 62, causes the elastic latch 4 to be deflected outwardly until the board reached a final contact position where the printed circuit board is held by the elastic latches.

In prior art connectors, the contact is made slender so that the spring may be deflected more with less force. However, such prior art connectors encounter a problem due to insufficient mechanical strength. According to the present invention, this problem can be solved by providing a deep U-shaped portion 64*c* of the spring portion 64 of the second contact means 62 and thereby positioning the contact's pivot at a point remote from the contact portion 62*a*.

The contact according to the present invention can deflect far with low spring force, in spite of being small in dimension. This minimizes the wear on the insertion edge of the printed circuit board as well as the insertion force necessary to insert the circuit board into the contact. Furthermore, the connector and contact of the present invention provide a stabler contact with the circuit board while allowing adequate deflection of the spring.

Figure 6:
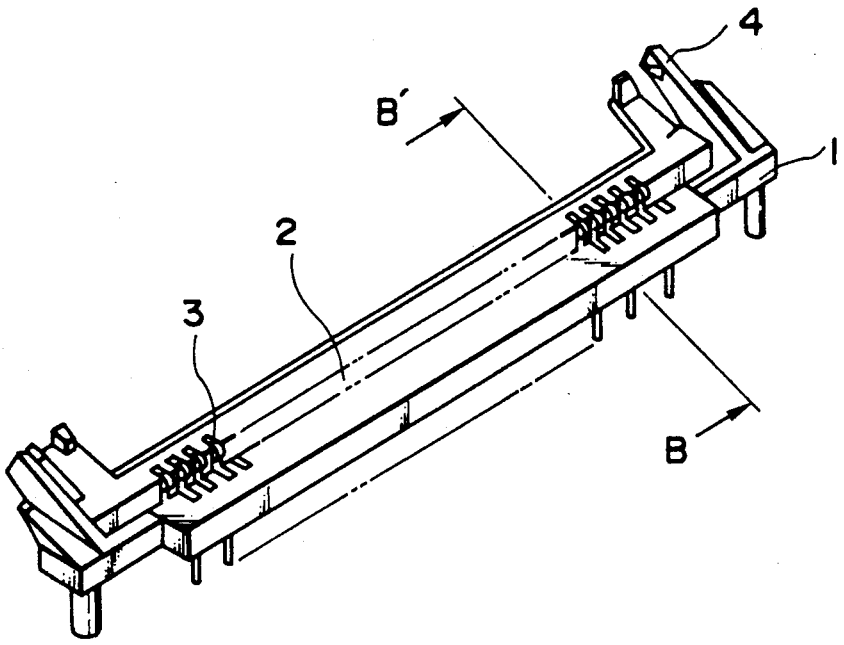
FIG. 6 is a respective view showing a low insertion force connector according to another embodiment of the present invention.
Figure 7:
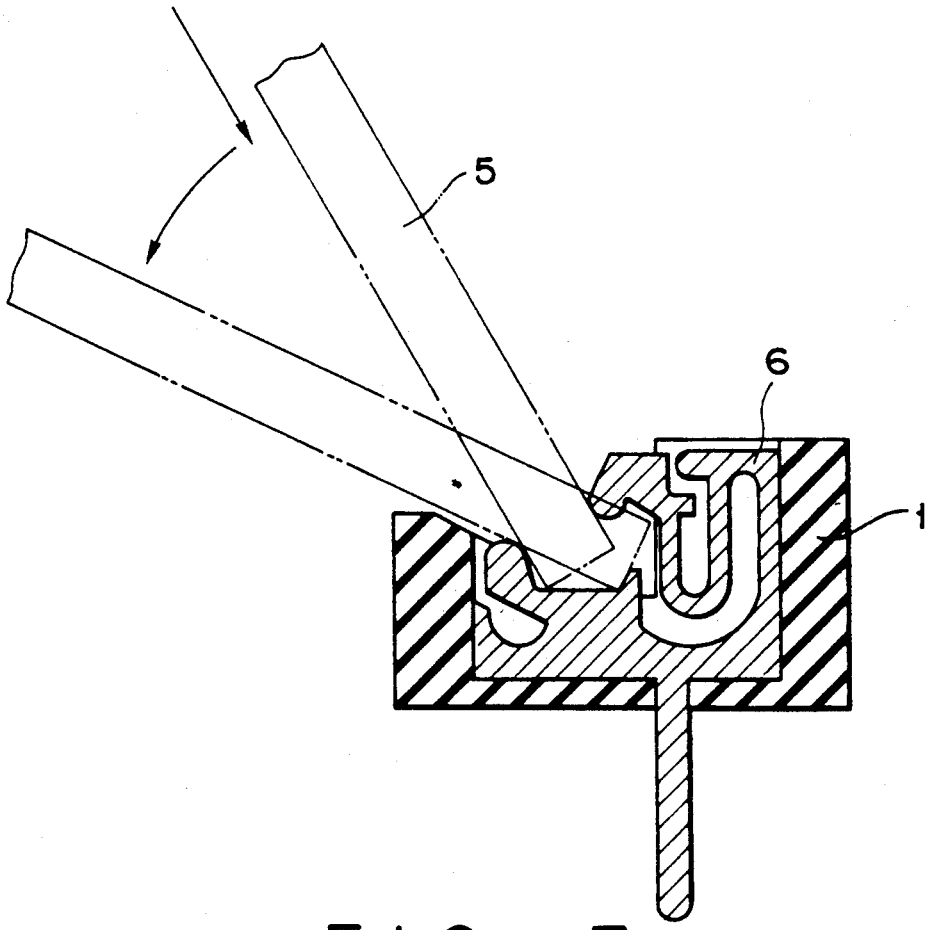
FIG. 7 is a cross-sectional view, taken along line B—B' in FIG. 6, showing rotation of an inserted printed circuit board to a final horizontal position.

FIGS. 6 and 7 show another embodiment of the present invention according to which the circuit board 5 is rotated until it assumes a generally horizontal position in its final contact position. The final contact position of the circuit board described above in connection with the embodiment of FIGS. 4 and 5 is generally vertical. The contact 6 of FIG. 7 is otherwise substantially similar to that of FIGS. 4 and 5, particularly with respect to the second contact means and the U-shaped spring portion.

It should be understood that the foregoing are but two embodiments of the present invention and that various changes may be made without departing from the spirit and scope of this invention.

What is claimed is:

1. An electrical contact for a low insertion force connector comprising:

first contact means having a first contact portion for contacting one surface of a substrate, second contact means having a second contact portion for contacting a second surface of the substrate, a raised portion located between said first and second contact means, said raised portion providing a surface for supporting an edge of said substrate as it is inserted between the first and second contact means and rotated into a final position where said first contact portion electrically contacts a first contact area on said one surface and said second contact portion electrically contacts a second contact area on said second surface.

a pin portion located between said first and second contact means; and a spring portion forming part of said second contact means and located between the second contact portion and the raised portion, said spring portion including a base portion connected to the raised portion and the pin portion, a vertical portion extending vertically from said base portion, and a U-shaped portion extending from the top of the vertical portion and terminating at its other end in said second contact portion.

2. An electrical contact according to claim 1, further comprising a stop means disposed in said spring portion at the location where the U-shaped portion meets the vertical portion, said second contact portion abutting against said stop means when it is deflected by insertion of and rotation of said substrate.

3. An electrical contact according to claim 1, wherein said first and second contact means are adapted to retain said substrate substantially vertical between said first and second contact portions.

4. An electrical contact according to claim 1, wherein said first and second contact means are adapted to retain said substrate substantially horizontal between said first and second contact portions.

5. A low insertion force connector comprising:

an elongated housing made of an insulating material and having an elongated cavity in a longitudinal direction;

a plurality of contacts disposed at predetermined intervals along the length of the elongated cavity and adapted to contact an edge of a printed circuit board;

each said contact comprising first contact means having a first contact portion for contacting one surface of the edge of the printed circuit board, second contact means having a second contact portion for contacting an opposite surface of the edge of the printed circuit board, and a pin portion for supporting the first and second contact means;

said second contact means further including a spring portion located between the second contact portion and the pin portion, said spring portion comprising a base portion connected to the pin portion, a vertical portion extending vertically from the base portion, and a U-shaped portion extending from the top of the vertical portion and having a free end terminating in said second contact portion, and a pair of latches located on opposite ends of the elongated housing providing a spacing defined therebetween above the cavity, said latches being elastic and adapted to engage opposite sides of the printed circuit board as its edge is inserted into the elongated cavity between the first and second contact portions of said contact means and rotated until it is latched in its final contact position by said latches.

6. A low insertion force connector according to claim 5, wherein said substrate is oriented substantially vertical to the connector in said final contact position.

7. A low insertion force connector according to claim 5, wherein said substrate is oriented substantially horizontal to the connector in said final contact position.

* * * * *